US011253018B2

(12) United States Patent
Kuipers et al.

(10) Patent No.: US 11,253,018 B2
(45) Date of Patent: Feb. 22, 2022

(54) POCKET ASSEMBLY AND RELATED METHODS

(71) Applicants: Jason Kuipers, Dana Point, CA (US); Kara Kuipers, Dana Point, CA (US)

(72) Inventors: Jason Kuipers, Dana Point, CA (US); Kara Kuipers, Dana Point, CA (US)

( * ) Notice: Subject to any disclaimer, the term of this patent is extended or adjusted under 35 U.S.C. 154(b) by 307 days.

(21) Appl. No.: 14/587,492

(22) Filed: Dec. 31, 2014

(65) Prior Publication Data

US 2016/0183614 A1 Jun. 30, 2016

(51) Int. Cl.
*A41D 27/20* (2006.01)

(52) U.S. Cl.
CPC ..... *A41D 27/205* (2013.01); *A41D 27/201* (2013.01); *A41D 27/204* (2013.01)

(58) Field of Classification Search
CPC ..... A41D 27/20; A41D 27/205; A41D 27/201
USPC ..... 2/247, 253, 254
See application file for complete search history.

(56) References Cited

U.S. PATENT DOCUMENTS 235,919 A * 12/1880 Vogel ..... A41D 27/20 2/253
555,433 A * 2/1896 Curran ..... A41D 27/20 2/253
605,840 A * 6/1898 Bandler ..... A41D 27/20 2/253
1,036,054 A * 8/1912 Abrahams ..... A41D 27/20 2/254
1,123,539 A 1/1915 Inke
1,226,640 A * 5/1917 Charles ..... A41D 27/20 2/254
1,669,791 A 12/1926 Stocks
1,786,879 A * 12/1930 Vineberg ..... A41D 27/20 2/254
2,369,208 A 8/1942 Brangaccio
2,407,888 A 9/1946 Lesser
2,899,684 A * 8/1959 Riley ..... A41D 27/207 2/254
4,499,612 A * 2/1985 Koike ..... A41D 27/20 2/250

(Continued)

FOREIGN PATENT DOCUMENTS

RU 2007942 C1 2/1994
RU 105803 U1 6/2011

*Primary Examiner* — Sally Haden
(74) *Attorney, Agent, or Firm* — Adam R. Stephenson, LTD.

(57) ABSTRACT

A pocket assembly includes an outer panel coupled with a middle panel. The middle panel is coupled between the outer panel and a clothing article. A base is coupled with the outer panel. An elastic portion is formed in the base or the outer panel, or both. A first compartment is formed between the outer panel and middle panel. A second panel is formed between the middle panel and the clothing article and is accessible only through a bottom opening. The elastic portion stretches, in response to downward force, to increase the size of the bottom opening. A back panel may, in implementations, be coupled between the middle panel and the clothing article, and in such implementations the second compartment may be comprised between the middle panel and the back panel. The pocket assembly has only a single opening allowing entry into the first compartment from outside the pocket assembly.

18 Claims, 6 Drawing Sheets

(56) References Cited

U.S. PATENT DOCUMENTS

| | | | | |
|---|---|---|---|---|
| 6,363,538 | B1 * | 4/2002 | Davis | A41D 27/202 2/238 |
| 8,407,816 | B2 | 4/2013 | Rhoades, II | |
| 8,745,768 | B1 | 6/2014 | Moghaddas | |
| 2009/0205102 | A1 | 8/2009 | Anderson | |
| 2016/0095372 | A1 * | 4/2016 | Peterson | A41D 27/201 2/248 |

* cited by examiner

POCKET ASSEMBLY AND RELATED METHODS

BACKGROUND

1. Technical Field

Aspects of this document relate generally to pockets. Specific implementations relate to clothing pockets.

2. Background Art

Articles of clothing and other items include pockets. Shirts, shorts, pants, jackets, and the like, and other items, include pockets. Pockets often have an upper opening to allow an item to be placed therein from above. Some pockets include a closure to close the upper opening to prevent or hinder items from exiting the upper opening. This closure may be in the form of a zipper, a button, hook-and-loop fasteners, drawstrings, or the like. Other pockets lack such a closure.

SUMMARY

Implementations of pocket assemblies may include: an outer panel coupled with a middle panel, the middle panel coupled between the outer panel and one of a clothing article and a bag, and; a base coupled with the outer panel; wherein one of the outer panel and base includes an elastic portion; wherein a first compartment is formed between the outer panel and middle panel; wherein a second compartment is formed between the middle panel and one of the clothing article and the bag and is accessible only through a bottom opening, and; wherein the elastic portion is configured to stretch to increase a size of the bottom opening.

Implementations of pocket assemblies may include one, all, or any of the following:

A back panel may be coupled between the middle panel and one of the clothing article and the bag, and the second compartment may be formed between the middle panel and the back panel.

Each of the outer panel, middle panel and back panel may have four edges.

Only two edges of the outer panel may be stitched to the middle panel.

The first compartment may be accessible from outside the pocket assembly only through a top opening on an opposite side of the pocket assembly from the bottom opening.

The elastic portion may be configured to increase the size of the bottom opening in response to a manual force exerted by a user and to decrease the size of the bottom opening in response to a lack of manual force exerted by a user.

The pocket assembly may be configured to disallow entry of an item into the second compartment until a user manually increases the size of the bottom opening by stretching the elastic portion.

The pocket assembly may be configured to disallow removal of an item placed in the second compartment until a user manually increases the size of the bottom opening by stretching the elastic portion.

The pocket assembly may be formed on one of: shorts; pants; and a shirt.

Implementations of pocket assemblies may include: an outer panel coupled to a middle panel with stitching; a back panel coupled to the middle panel and to a clothing article with stitching, and; a base coupled to the outer panel and one of the middle panel and back panel with stitching; wherein one of the outer panel and base includes an elastic portion; wherein a first compartment is formed between the outer panel and middle panel; wherein a second compartment is formed between the middle panel and the back panel and is accessible only through a bottom opening, and; wherein the elastic portion is configured to stretch to increase a size of the bottom opening.

Implementations of pocket assemblies may include one, all, or any of the following:

An inside of the pocket assembly may be accessible from outside the pocket assembly only through a top opening formed between the outer panel and middle panel and located on a side of the pocket assembly opposite the bottom opening.

The elastic portion may be configured to increase the size of the bottom opening in response to a manual force exerted by a user and to decrease the size of the bottom opening in response to a lack of manual force exerted by a user.

Each of the outer panel, middle panel and back panel may have four edges.

Only two edges of the outer panel may be stitched to the middle panel.

The pocket assembly may be configured to disallow entry of an item into the second compartment until a user manually increases the size of the bottom opening by stretching the elastic portion.

The pocket assembly may be configured to disallow removal of an item retained in the second compartment until a user manually increases the size of the bottom opening by stretching the elastic portion.

The item retained in the second compartment may be sized at least as large as a cell phone.

The pocket assembly may be formed in one of: shorts; pants; and a shirt.

Implementations of methods of using a pocket assembly may include: inserting an item into a first compartment of a pocket assembly, the first compartment formed between an outer panel and a middle panel, the outer panel and middle panel stitched together along two edges of the outer panel; pressing down on an elastic base of the pocket assembly to increase a size of an opening from the first compartment to a second compartment, wherein the elastic base is coupled to the outer panel and wherein the second compartment is formed between the middle panel and a clothing article; transferring the item from the first compartment to the second compartment through the opening; and reducing the size of the opening by ceasing to press down on the elastic base of the pocket assembly.

Implementations of methods of using a pocket assembly may include one, all, or any of the following:

The size of the opening, when there is no downward pressure on the elastic base, may be too small to allow the item to pass through the opening.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 1:
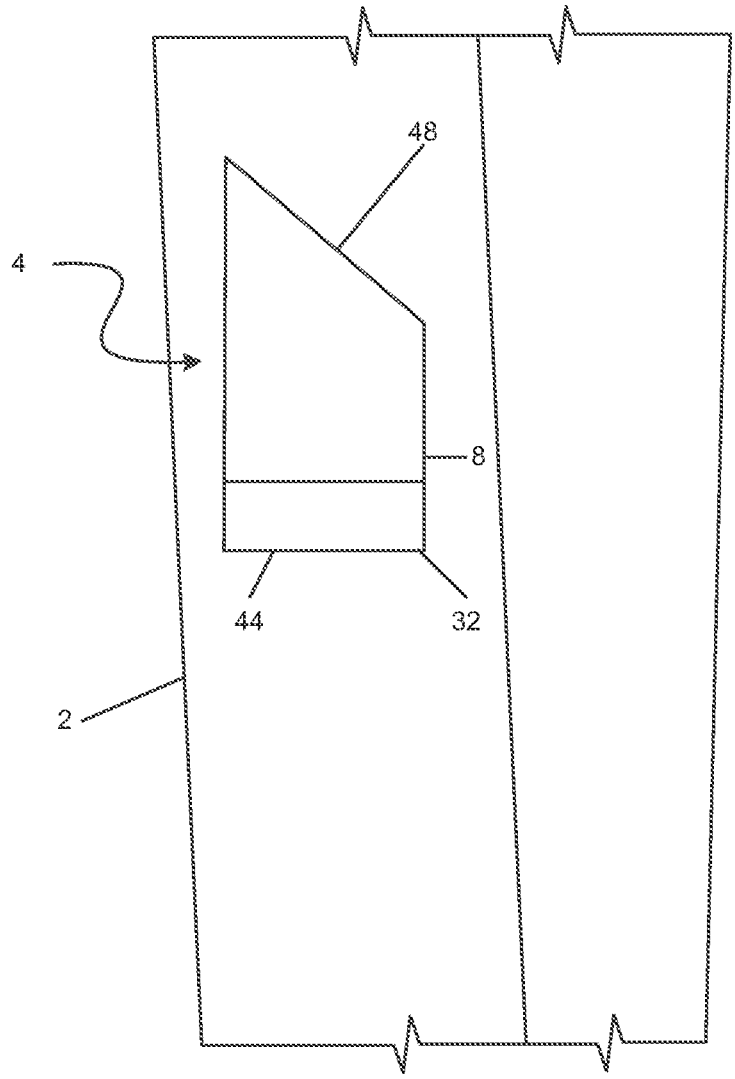
FIG. 1 is front view of an implementation of a pocket assembly coupled to a clothing article.

This disclosure, its aspects and implementations, are not limited to the specific components, assembly procedures or method elements disclosed herein. Many additional components, assembly procedures and/or method elements known in the art consistent with the intended pocket assemblies and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such pocket assemblies and related methods, and implementing components and methods, consistent with the intended operation and methods.

Referring now to FIGS. 1-7, in implementations a pocket assembly 4 may be coupled to a clothing article 2 and includes an outer panel 8, a middle panel 16 and a base 32. The clothing article 2 may be, by non-limiting example, a pair of shorts, a pair of pants, a shirt, a blouse, sweatpants, swimming trunks, a hoodie, a jacket, and any other item of clothing. In the implementations shown in the drawings the clothing article 2 is a leg of a garment. An inside 6 of the pocket assembly 4 is defined as any portion of the pocket assembly 4 within any volume defined by at least three of the outer panel 8, base 32, middle panel 16, back panel 24 and the clothing article 2. An outside of the pocket assembly 4 is defined as any area/volume that is not defined as the inside 6.

Referring now to FIGS. 4A-4E, a number of panels may be used to form pocket assembly 4. These panels may be formed of any material, elastic or non-elastic. An outer panel 8 includes a top edge 10, side edges 12 and bottom edge 14. Outer panel 8 may be stitched to middle panel 16 using stitching 42. As seen on FIG. 4A, the stitching 42 coupling outer panel 8 to middle panel 16 may be present only along the side edges 12. The middle panel 16 includes a top edge 18, side edges 20 and bottom edge 22. In the representative example of FIG. 4B these edges align with the edges of the outer panel 8 such that the middle panel and outer panel form the same shape. In other implementations the middle panel and outer panel could form different shapes, so long as the middle panel forms a division of the inside 6 of the pocket assembly 4 sufficient for storage of an item 54, as will be discussed hereafter. Similarly, though the top edges 10, 18 are shown as slanted, they could instead be parallel with the bottom edges 14, 22, and/or any of the edges of either of these panels, or of other panels, could be rounded, wavy, and the like, and still perform the functions described herein.

Figure 4A:
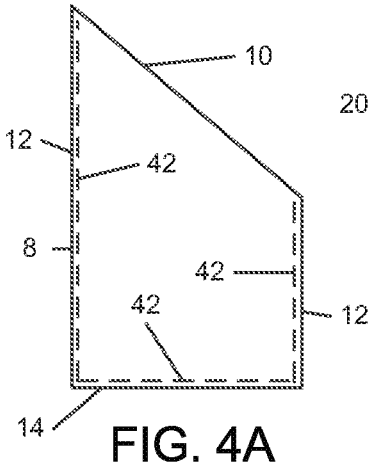
FIG. 4A is a front view of an outer panel of the pocket assembly of FIG. 1.
Figure 4B:
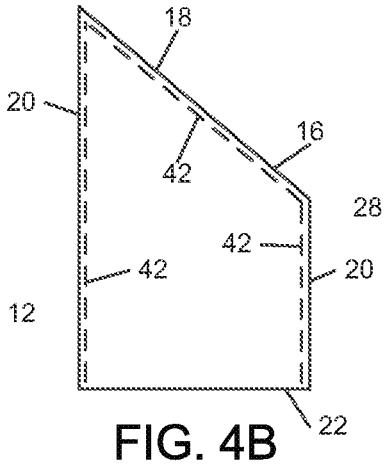
FIG. 4B is a front view of a middle panel of the pocket assembly of FIG. 1.
Figure 4C:
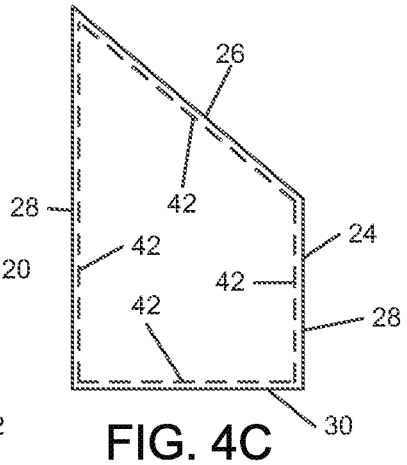
FIG. 4C is a front view of a back panel of the pocket assembly of FIG. 1.
Figure 4D:
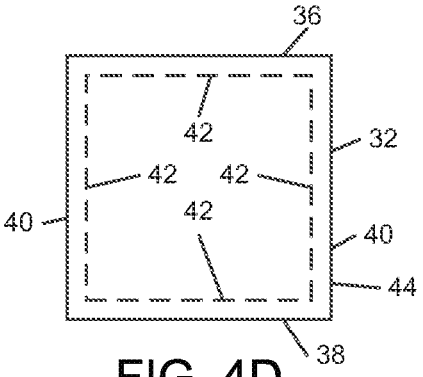
FIG. 4D is a top view of a base of the pocket assembly of FIG. 1.
Figure 4E:
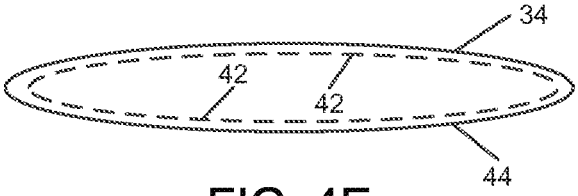
FIG. 4E is a top view of another implementation of a base of a pocket assembly.

Outer panel 8 is shown with stitching 42 along its side edges 12 and bottom edge 14 but not its top edge 10. The top edge 10 is not stitched to anything because the top opening 48 of the pocket assembly 4 is defined between the top edge 10 and the top edge 18. Thus, the top edge 10 of the outer panel 8 is not sewn to the middle panel 16. The bottom edge 14 is not sewn to the middle panel 16, but is sewn to the base 32, and in implementations the bottom edge 14 is sewn to two side edges 40 and a bottom edge 38 of base 32, while a top edge 36 of the base is sewn to either the back panel 24 or to the clothing article 2. The base 32, shown in FIG. 4D, is not sewn to the middle panel 16. FIG. 4E shows an alternative implementation of a base 34 which has an elliptical shape, in this implementation the upper stitching 42 may be stitched to the back panel or clothing article while the lower stitching 42 may be stitched to the outer panel. The side edges 12, 20, 28 are sewn to side edges 40 of the base 32, in implementations.

Middle panel 16 is shown with stitching 42 along its top edge 18 and side edges 20 but not its bottom edge 22. This is because middle panel 16 is stitched along these edges to either the back panel 24 or directly to the clothing article 2. The back panel 24 in some instances may be excluded, though in the implementations in which it is included the back panel 24 may be stitched along all of its edges, the top edge 26, side edges 28 and bottom edge 30, to the clothing article 2, as shown in FIG. 4C.

The pocket assembly 4 includes two compartments. These can be seen in the side cross-section view of FIG. 7. A first compartment 46 is formed between the outer panel 8 and middle panel 16, while a second compartment 50 is formed between the middle panel 16 and either the back panel 24, if the back panel 24 is included, or the clothing article 2. In the implementation shown in FIG. 7 the back panel is excluded. The first compartment 46 is accessible via top opening 48, similar to a conventional pocket, and in implementations has no closure mechanism whereby top opening 48 may be closed, though in implementations a closure mechanism could be included, such as a flap with a button, a zipper, hook-and-loop fasteners, a magnetic fastener, or the like. The second compartment 50 is accessible only through the opening (bottom opening) 52.

The pocket assembly 4 includes an elastic portion 44. The elastic portion 44 in implementations is formed in one or both of the outer panel 8 and the base 32. In the implementations shown in the drawings the elastic portion 44 is formed only in the base 32. The base 32, accordingly, in the implementations shown, is the elastic portion 44. The elastic portion 44 is formed of an elastic material that may be stretched to increase the size of opening 52 and, accordingly, allow an item 54, such as a cell phone 56 or other item, entry into the second compartment 50. After an item 54 has been placed into the second compartment 50, the elastic portion 44 may be contracted to reduce the size of opening 52 and, accordingly, prevent the item 54 from exiting the second compartment 50 through opening 52. Because the second compartment 50 is closed on the other three sides (top and sides) and only open on the bottom at opening 52, an item 54 when placed therein is thus secured from exiting. Accordingly, a user wearing the clothing article 2 may run, jump, position himself/herself upside down, and the like, without the item 54 exiting the pocket assembly 4.

The elastic portion 44 tends towards a contracted configuration in which the opening 52 is too small to allow an item 54 to pass therethrough, but a user may manually expand the elastic portion 44 to enlarge opening 52, such as by pushing down on the base 32 using the item 54 itself and then, when the opening 52 is large enough to admit the item 54 into the second compartment 50, pushing the item 54 therethrough. The user may then remove the pushing force and the opening 52 will reduce in size to maintain the item 54 within the second compartment 50. To remove the item 54 the user may push down directly on the base 32, or push downwards on the item 54 through the material of the pocket assembly 4 so that the base 32 receives downwards pressure, so that the opening 52 is enlarged, and then remove the item 54.

As can be seen from the drawings, the pocket assembly 4 may be fully incorporated with, or within, the clothing article 2.

The first compartment 46, as described above, forms a conventional pocket compartment, while the second compartment 50 forms a secure pocket within the conventional pocket. Items needing to be secured, for whatever reason, may be stored in the secure pocket. The secure pocket may be used to hold items during sports or other activities. The secure pocket could also be used to hinder theft. For instance a wallet, money, car keys, cell phone, credit cards, identification, and the like, could be placed in the secure pocket, and may be less likely to be stolen or even noticed. The secure pocket may also prevent items from falling out of the pocket assembly 4 when a user sits down, which in some instances can cause items within a conventional pocket to fall out.

Figure 2:
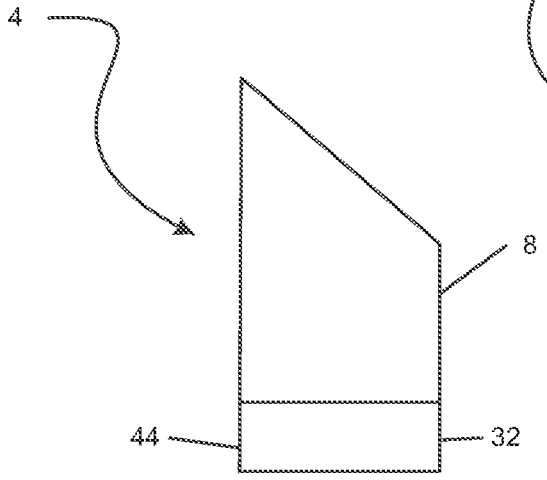
FIG. 2 is a front view of the pocket assembly of FIG. 1 in a non-extended configuration.
Figure 3:
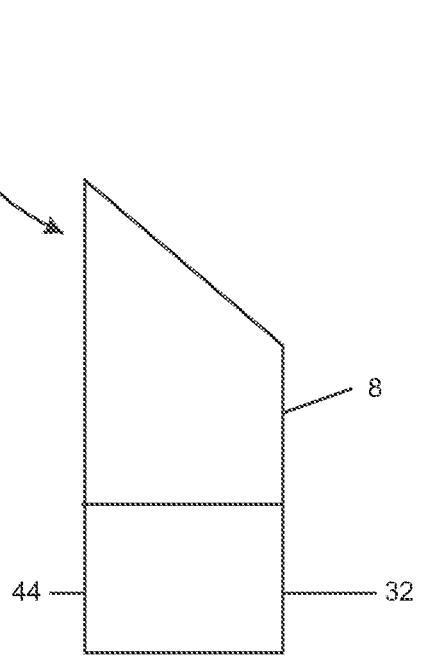
FIG. 3 is a front view of the pocket assembly of FIG. 1 in an extended configuration.
Figure 5:
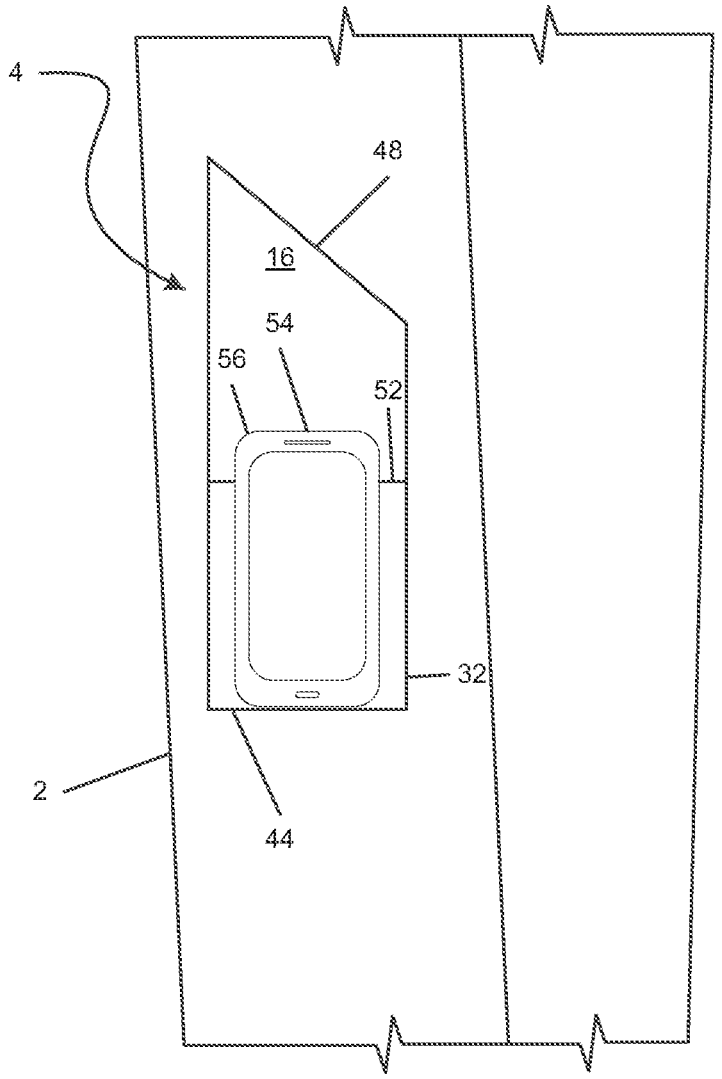
FIG. 5 is a front partial see-through view of the pocket assembly of FIG. 1 with an item placed in the first compartment and with the outer panel not shown for ease of viewing, and with the pocket assembly in an extended position.
Figure 6:
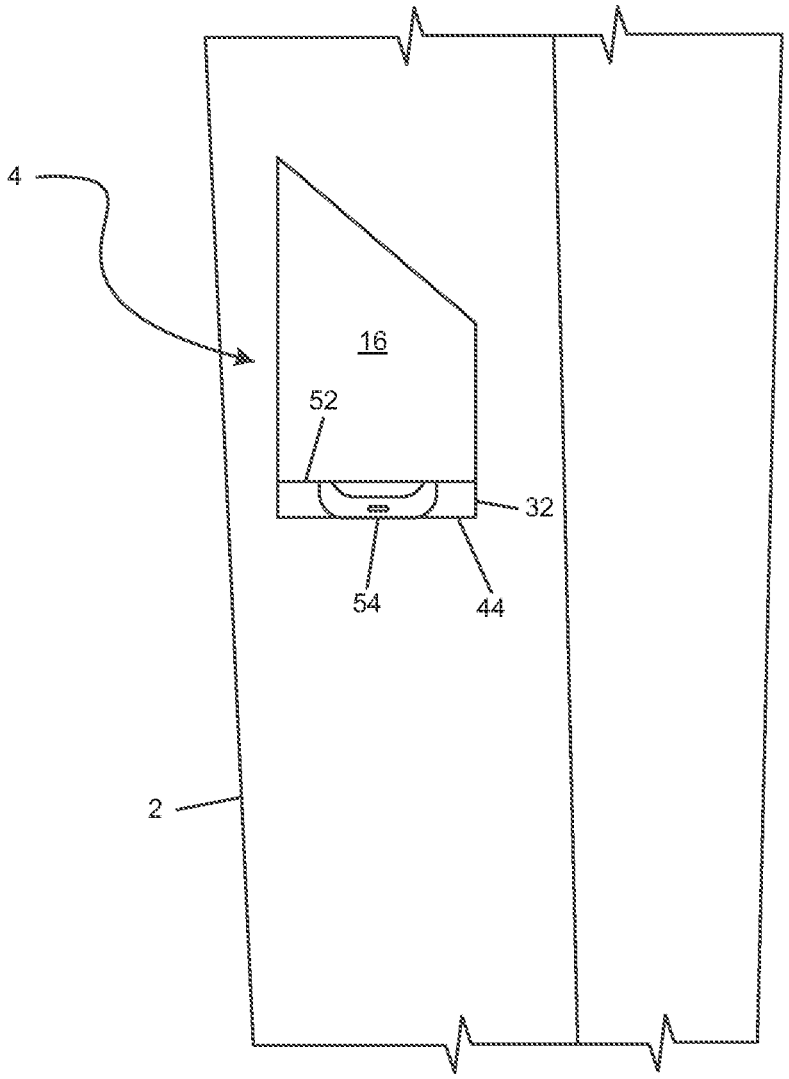
FIG. 6 is a front partial see-through view of the pocket assembly of FIG. 1 with an item placed in the second compartment and with the outer panel not shown for ease of viewing, and with the pocket assembly in a non-extended position.
Figure 7:
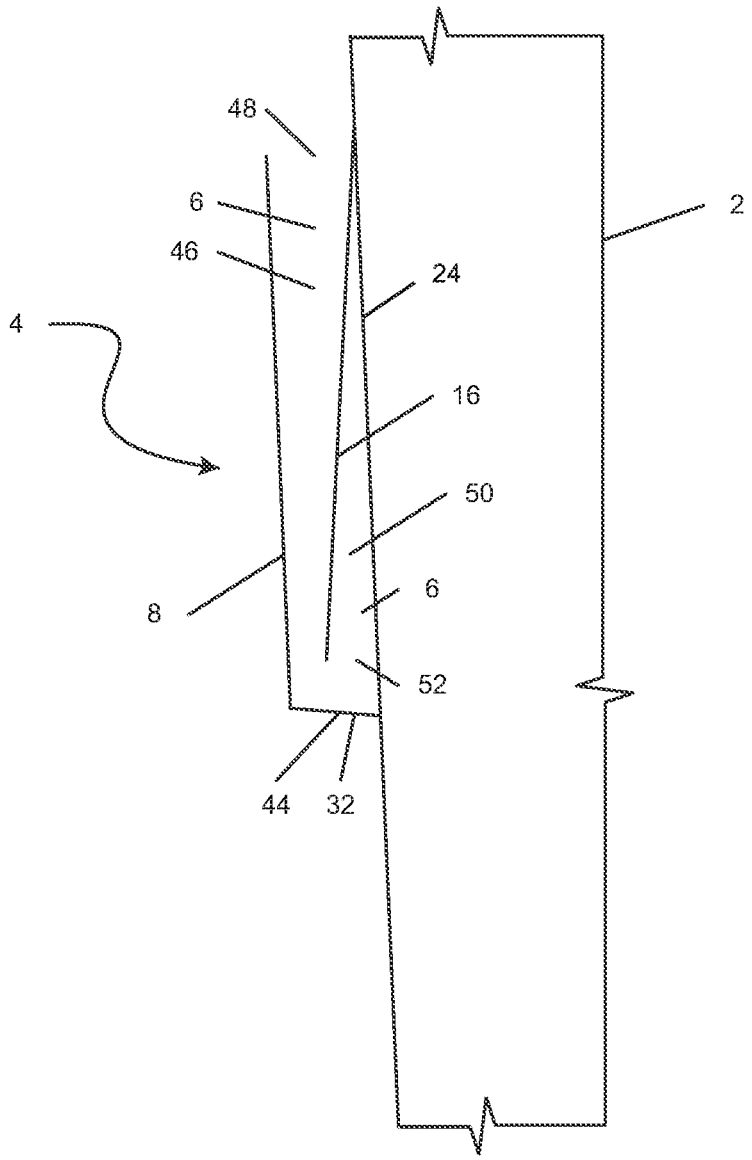
FIG. 7 is a side cross-section view of an implementation of a pocket assembly.

FIG. 2 shows the pocket assembly 4 with the base 32 in a contracted or, in other words, a non-expanded configuration. FIG. 3 shows the pocket assembly 4 with the base 32 in an expanded configuration. As shown in FIGS. 4A-4C, the panels may all have identical shapes, in implementations. In other implementations they may have different shapes so long as they still form a secure pocket within the conventional pocket accessible only through opening 52 which is enlarged by expanding the base 32. FIG. 5 shows a cell phone 56 being pushed downwards to expand the base 32 and increase the size of opening 52. FIG. 6 shows the cell phone 56 of FIG. 5 after the opening 52 was enlarged enough to allow the cell phone 56 admittance into the second compartment 50, and after the user has removed the downwards pressure so that the base 32 contracts, reducing the size of opening 52 so that the cell phone 56 is held secure in the second compartment 50.

In implementations it is the retraction of the elastic portion 44 itself which pushes item 54 upwards into the second compartment 50 through the opening 52 once the user releases the downwards pressure.

The pocket assembly 4 may be substituted for a conventional slit pocket, slash pocket or seam pocket on the clothing article 2. As can be seen in the drawings, the pocket assembly 4 includes a first, right-side-up pocket, along with an upside-down pocket inside the right-side-up pocket.

The back panel 24, when included, abuts a body of the user through the clothing article 2.

The elastic portion 44 may be formed of any elastic material such as materials sold under the trade names LYCRA and/or SPANDEX by DuPont of Wilmington, Del., or any other stretchy or elastic material. In some implementations the elastic material may include rubber, but in other implementations the elastic material will not include rubber, so long as the elastic material is stretchy in nature such that it may be stretched to increase the size of the opening 52 when pressure is applied thereon and, when the pressure is released, will tend towards its previous non-stretched configuration to decrease the size of the opening 52. The elastic material may include a synthetic polymer. In implementations the elastic material may be any material capable of stretching in at least one direction 110%, 120%, 130%, 140%, 150%, 160%, 170%, 180%, 190%, or 200% of an original length when pressure is applied thereon and then reverting to the original length when the pressure is removed. The elastic material may include a synthetic fabric which undergoes two-way stretch or four-way stretch.

The size and shape of the pocket assembly 4 and of any of its constituents may be adjusted to be utilized with any size, shape and type of clothing article 2.

As viewed by an observer other than the user, the pocket assembly 4 appears as a conventional pocket and is aesthetically pleasing.

Although stitching 42 is used in the implementations shown in the drawings, in other implementations an adhesive or other coupling mechanism may be used to couple panels and other items together.

In implementations the opening 52 may be, instead of on a bottom portion of the pocket assembly 4, along a side portion, so that a side force is used to access the second compartment 50. Naturally, in such an implementation the stitching may be modified, so that the base 32 or elastic portion 44 is instead sown to the sides of the panels, while the bottom edges 14, 22 and, if the back panel 24 is included, the bottom edge 30, are sewn together. Thus a corresponding side edge 12 and if the back panel 24 is included, side edge 28, would be sewn to the base 32 (i.e., the base 32 would be on a side of the pocket assembly 4, not on the bottom), and the side edge 20 of the middle panel 16 would not be sewn to the base 32 or otherwise attached thereto.

In places where the description above refers to particular implementations of pocket assemblies and related methods and implementing components, sub-components, methods and sub-methods, it should be readily apparent that a number of modifications may be made without departing from the spirit thereof and that these implementations, implementing components, sub-components, methods and sub-methods may be applied to other pocket assemblies and related methods.

What is claimed is:

1. A pocket assembly, comprising:

an outer panel coupled with a middle panel, the middle panel coupled between the outer panel and one of a clothing article or a bag, and;

a base coupled with the outer panel;

wherein only one of the outer panel or the base comprising an elastic portion:

wherein a first compartment is comprised between the outer panel and the middle panel;

wherein a second compartment is comprised between the middle panel and the one of the clothing article or the bag and is accessible by a user only from the first compartment through a single opening in the second compartment where the elastic portion is configured to stretch to increase a size of the single opening to permit placement of an object from within the first compartment into the second compartment.

2. The pocket assembly of claim 1, wherein the second compartment is comprised between the middle panel and a back panel.

3. The pocket assembly of claim 2, wherein the base is formed from a separate piece of material that is stitched to the outer panel and to the back panel.

4. The pocket assembly of claim 2, wherein the base is not formed from the outer panel and is not formed from the back panel.

5. The pocket assembly of claim 1, wherein the outer panel has multiple edges and only two edges of the outer panel are stitched to the middle panel.

6. The pocket assembly of claim 1, wherein the first compartment is accessible from outside the pocket assembly only through a top opening on an opposite side of the pocket assembly from the single opening.

7. The pocket assembly of claim 1, wherein the elastic portion is configured to increase the size of the single opening in response to a manual force exerted by a user and to decrease the size of the single opening in response to a lack of manual force exerted by a user.

8. The pocket assembly of claim 1, wherein the pocket assembly is configured to disallow entry of an item into the second compartment until a user manually increases the size of the single opening by stretching the elastic portion.

9. The pocket assembly of claim 1, wherein the pocket assembly is configured to disallow removal of an item placed in the second compartment until a user manually increases the size of the single opening by stretching the elastic portion.

10. The pocket assembly of claim 1, wherein the base comprises one of a rectangular shape and an elliptical shape.

11. A pocket assembly, comprising:

an outer panel coupled to a middle panel;

a back panel coupled to the middle panel and to a clothing article, and;

a base coupled to the outer panel and one of the middle panel and the back panel;

wherein only one of the outer panel or the base comprises an elastic portion;

wherein a first compartment is comprised between the outer panel and the middle panel and wherein a second compartment is comprised between the middle panel and the back panel;

wherein the second compartment is accessible by a user only from the first compartment through a bottom opening in the second compartment where the elastic portion is configured to stretch to increase a size of the bottom opening.

12. The pocket assembly of claim 11, wherein an inside of the pocket assembly is accessible from outside the pocket assembly only through a top opening formed between the outer panel and middle panel and located on a side of the pocket assembly opposite the bottom opening.

13. The pocket assembly of claim 11, wherein the elastic portion is configured to increase the size of the bottom opening in response to a manual force exerted by a user and to decrease the size of the bottom opening in response to a lack of manual force exerted by a user.

14. The pocket assembly of claim 11, wherein the outer panel has multiple edges and only two edges of the outer panel are stitched to the middle panel.

15. The pocket assembly of claim 11, wherein the pocket assembly is configured to disallow entry of an item into the second compartment until a user manually increases the size of the bottom opening by stretching the elastic portion.

16. The pocket assembly of claim 11, wherein the pocket assembly is sized to disallow removal of an item retained in the second compartment until a user manually increases the size of the bottom opening by stretching the elastic portion.

17. The pocket assembly of claim 16, wherein the pocket assembly is sized to disallow removal of a cell phone retained in the second compartment until a user manually increases the size of the bottom opening by stretching the elastic portion.

18. The pocket assembly of claim 11, wherein the base is formed from a separate piece of material that is stitched to the outer panel and to the back panel.

* * * * *